US005579793A

United States Patent [19]

Gajewski et al.

[11] Patent Number: 5,579,793

[45] Date of Patent: Dec. 3, 1996

[54] FOLDABLE WALKER

[75] Inventors: Mark Gajewski; Evan T. Ward, both of Ann Arbor, Mich.; Shivaprasad Dhanapal, Statesville, N.C.

[73] Assignee: Rubbermaid Health Care Products, Inc., Statesville, N.C.

[21] Appl. No.: 559,281

[22] Filed: Nov. 15, 1995

[51] Int. Cl.[6] ..... A61H 3/00

[52] U.S. Cl. ..... 135/67; 135/74; 297/5; 482/66

[58] Field of Search ..... 135/67, 74, 65, 135/72; 482/66, 69; 297/5–7; 280/87.021, 87.041, 87.051

[56] References Cited

U.S. PATENT DOCUMENTS

| | | | |
|---|---|---|---|
| D. 246,036 | 10/1977 | Thomas | D12/130 |
| D. 246,302 | 11/1977 | Thomas | D12/130 |
| D. 268,017 | 2/1983 | Thomas | D12/130 |
| D. 268,404 | 3/1983 | Thomas | D12/130 |
| D. 295,155 | 4/1988 | Erfurth | D12/130 |
| D. 312,061 | 11/1990 | Smith | D12/130 |
| D. 329,833 | 9/1992 | Andersson et al. | D12/130 |
| D. 344,917 | 3/1994 | Kjell et al. | D12/130 |
| D. 356,762 | 3/1995 | Silbersky | D12/130 |
| D. 360,174 | 7/1995 | Kjell et al. | D12/130 |
| D. 361,050 | 8/1995 | Macmillan | D12/130 |
| 1,448,783 | 3/1923 | Blewitt et al. . | |
| 1,917,440 | 2/1932 | Finkbeiner et al. . | |
| 3,516,425 | 6/1970 | Rigal | 135/67 |
| 3,625,237 | 12/1971 | Wertz | 135/45 A |
| 3,690,652 | 9/1972 | Schneider | 135/67 X |
| 4,251,105 | 2/1981 | Barker | 297/6 |
| 4,298,016 | 11/1981 | Garelick | 135/67 |
| 4,616,668 | 10/1986 | Battiston | 135/75 |
| 4,619,282 | 10/1986 | Battiston | 135/67 |
| 4,640,301 | 2/1987 | Battiston, Sr. et al. | 135/67 |
| 4,748,994 | 6/1988 | Schultz et al. | 135/67 |
| 4,800,910 | 6/1989 | Gamm | 135/67 |
| 4,907,839 | 3/1990 | Rose et al. | 297/6 |
| 5,020,560 | 6/1991 | Turbeville | 135/67 |
| 5,188,139 | 2/1993 | Garelick | 135/67 |
| 5,201,333 | 4/1993 | Shalman et al. | 135/67 |
| 5,224,717 | 7/1993 | Lowen | 280/1.5 |
| 5,224,721 | 7/1993 | Santmann | 280/87.051 |
| 5,275,187 | 1/1994 | Davis | 135/67 |
| 5,433,235 | 7/1995 | Miric et al. | 135/67 |

OTHER PUBLICATIONS

Carex® Health Care Products advertisement, Catalog 9 (1992), 6 pages.

Carex® Health Care Products advertisement, Catalog 10 (1994/95), 14 pages.

Lumex Patient Care Products advertisement (1993), 10 pages.

Temco Health Care advertisement (1991), 7 pages.

Invacare advertisement (1994), 5 pages.

Guardian advertisement (1995), 4 pages.

PCP–Champion® advertisement "Ambulatory Aids Catalog", 6 pages (undated).

*Primary Examiner*—Lanna Mai

*Attorney, Agent, or Firm*—Renner, Kenner, Greive, Bobak, Taylor & Weber

[57] ABSTRACT

A foldable walker (10) includes a first pair of opposed legs (14,16) and a second pair of opposed legs (13,15). A housing (25) is positioned between the first pair of legs (14,16). The housing (25) carries a lock/release mechanism (35) that includes a depressible button (36). The button (36) is connected to levers (45,47) such that when the button (36) is depressed, the levers (45,47) rotate to translate rods (51,53), respectively. When the rods (51,53) are so moved, pawls (68) connected to the rods (51,53) are rotated out of their normal engagement with bosses (60) carried by the first pair of legs (14,16). The first pair of legs (14,16) may then be rotated with respect to the housing (25) so that the second pair of legs (13,15) are positioned adjacent to each other and to the housing (25). The button (36) will remain depressed until the first pair of legs (14,16) are again locked by the engagement of the pawls (68) with the bosses (60) so as to provide a visual indication that the first of pair legs (14,16) are unlocked.

20 Claims, 4 Drawing Sheets

FOLDABLE WALKER

TECHNICAL FIELD

This invention relates to a walker such as used by infirm people who utilize the same for assistance in mobility. More particularly, this invention relates to such a walker in which the legs thereof can be folded for compact storage and yet in which the legs thereof can be locked in place when in use.

BACKGROUND ART

A wide variety of walkers for inform or semi-invalid persons are known in the art. Such usually consist of two spaced and braced U-shaped frame members which constitute the legs of the walker and which are interconnected on one side by at least one bracing, the other side being open for the positioning of the user. Oftentimes, the feet on the side interconnected by the bracings can be provided with wheels for increased mobility.

Some walkers are provided with mechanisms which allow the legs to pivot relative to the bracing so that they can, in effect, be folded for storage of the walker. Such mechanisms are of wide and varied configurations, but all suffer from one problem or another. Many are quite complex, expensive to manufacture and difficult to operate, and most include a button or buttons which are depressed to release a latch mechanism so that the legs can rotate relative to the bracing. In some of these mechanisms, the buttons, the latch mechanism, and/or the linkage therebetween are exposed creating potential pinch points for the user. In other versions, spring biased buttons hold telescoping tubes of the walker in place and plastic sleeves are positioned over the buttons to minimize the pinching problem. However, with these versions, the user cannot observe the position of the buttons and thus does not know whether the walker is in a locked, usable condition. Such could be a safety detriment to the already weakened user.

DISCLOSE OF THE INVENTION

It is thus an object of the present invention to provide a foldable walker which is safe for the infirm person to use.

It is another object of the present invention to provide a foldable walker, as above, which provides the user with a visual indication that the legs are locked in place.

It is a further object of the present invention to provide a foldable walker, as above, wherein the locking components are carried in a housing thereby eliminating any pinch points during the operation thereof.

It is an additional object of the present invention to provide a foldable walker, as above, which is easy to manipulate into the folded condition with a minimum of force provided by the user.

It is yet another object of the present invention to provide a foldable walker, as above, which can carry or store items which would have otherwise had to have been carried by the user.

It is a still further object of the present invention to provide a foldable walker, as above, which is simple to operate and easy to manufacture and assemble.

These and other objects of the present invention, as well as the advantages thereof over existing prior art forms, which will become apparent from the description to follow, are accomplished by the improvements hereinafter described and claimed.

In general, a foldable walker made in accordance with the concepts of the present invention includes a first pair of opposed legs having a housing positioned therebetween. A second pair of opposed legs are provided, with one leg of the second pair being opposed to one leg of the first pair of legs and the other leg of the second pair of legs being opposed to the other leg of the first pair of legs. A latch/release mechanism is carried by the housing to selectively lock the first pair of legs to prevent rotation thereof relative to the housing or release the first pair of legs to permit such rotation so that the second pair of opposed legs may be positioned adjacent to each other and adjacent to the housing. The latch/release mechanism includes a depressible button and a latch assembly for each leg which can engage the first pair of legs to prevent rotation thereof or can release the first pair of legs upon depression of the button. The button remains depressed until each latch assembly again engages the first pair of legs to prevent rotation thereof so as to provide a visual indication that the first pair of legs are locked against rotation.

A preferred exemplary foldable walker incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
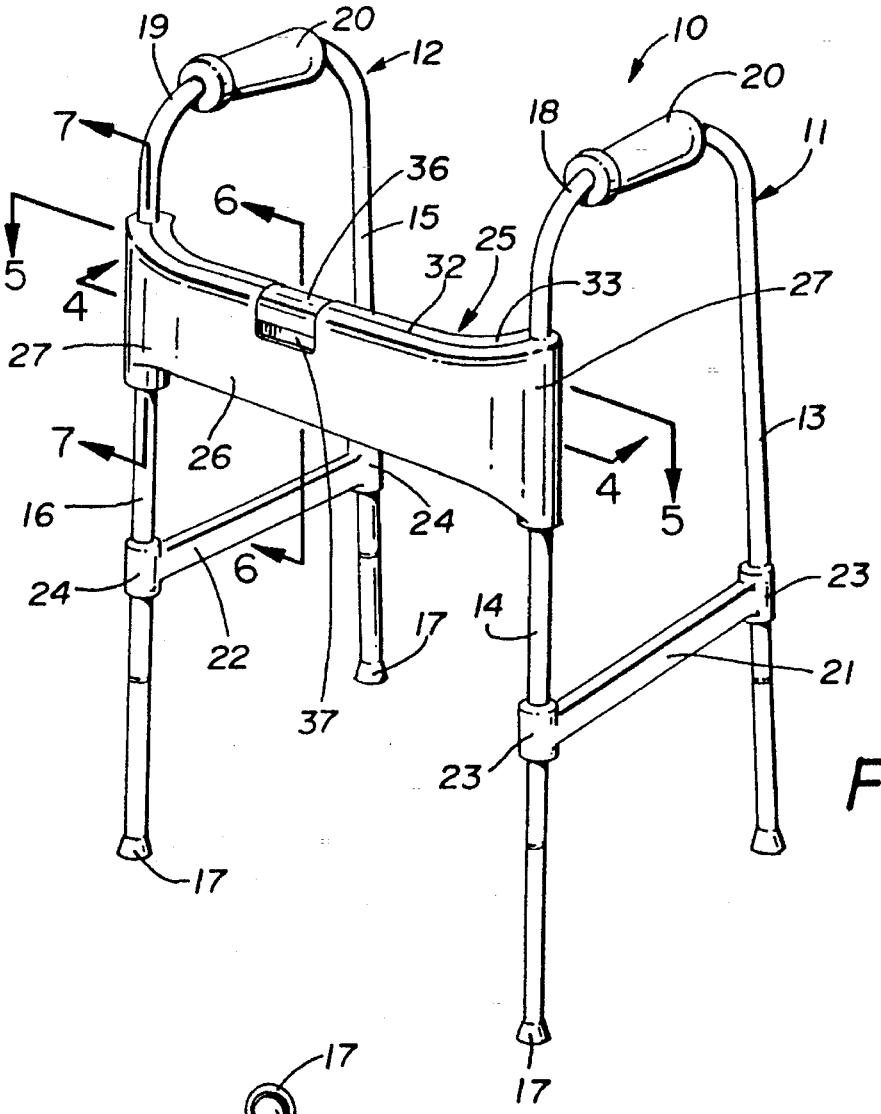
FIG. 1 is a perspective view of a foldable walker made in accordance with the concepts of the present invention.

A foldable walker made in accordance with the concepts of the present invention is indicated generally by the numeral 10 and is shown as having two, opposed, U-shaped side frames generally indicated by the numerals 11 and 12. Side frames 11 and 12 are conventional items preferably formed of hollow metallic tubes. The branches 13 and 14 of side frame 11 and the branches 15 and 16 of side frame 12 constitute the legs of walker 10 and may be conventionally fitted with rubber feet 17. Alternatively, at least legs 14 and 16 can be provided with wheels, as desired. The top 18 of side frame interconnects leg branches 13 and 14 thereof and the top 19 of side frame 12 interconnects leg branches 15 and 16 thereof. Legs 14 and 16 are thus opposed to each other and to opposed legs 13 and 15, respectively. Tops 18 and 19 may each telescopically receive a grip sleeve 20 made of a soft, comfortable material so that the user may easily manipulate walker 10 in a conventional manner. Leg branches 13 and 14 of side frame 11 may be interconnected for structural support by a side brace 21. Similarly, leg branches 15 and 16 of side frame 12 may be interconnected by a side brace 22. Braces 21 and 22 are preferably made of a rigid plastic material and include end collars 23 and 24, respectively, received around their respective leg branches 13, 14, 15 and 16. For ease of manufacture and assembly, braces 21 and 22 may be formed of longitudinally split halves and snapped onto legs 13, 14, 15, 16 with an adhesive or other suitable fasteners being applied, as necessary.

Figure 2:
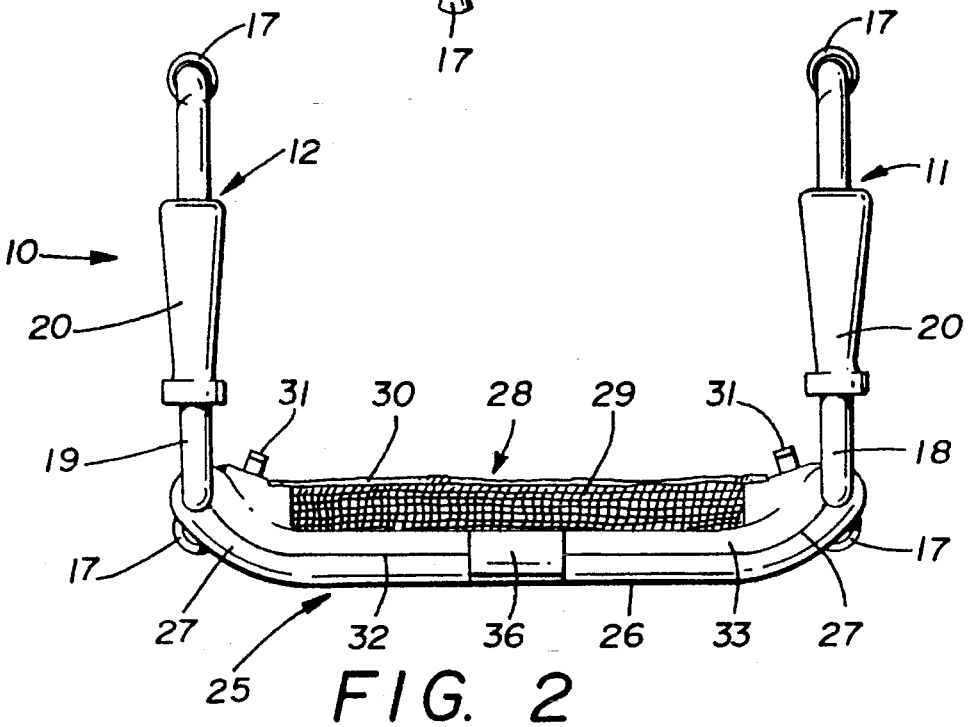
FIG. 2 is a top plan view of the foldable walker shown in FIG. 1.

A front brace in the form of a plastic hollow housing, generally indicated by the numeral 25, takes on the shape, as viewed in FIG. 2, of a shallow C having a generally flat front and rear surfaces 26 and opposed curved ends 27. A mesh pouch, generally indicated by the numeral 28, has a bottom surface 29 and a vertical surface 30 extending upwardly therefrom. Vertical surface 30 can extend approximately the height of housing 25 and pouch 28 can thus be utilized by the user of walker 10 to carry articles. Pouch 28 may be attached to housing 25 in any conventional fashion such as by using "Christmas tree" fasteners positioned in holes formed in housing 25. Curved ends 27 of housing 25 may also be provided with hooks 31 to enable the user to hang items, such as a purse, therefrom when walker is being used.

Housing 25 may be vertically split, as at seam line 32, into sections of approximate halves, for ease of assembly, with the sections being connected together in any known fashion. In addition to front and rear surfaces 26, the mated sections of housing 25 form a top surface 33 and a bottom surface 34. Housing 25 carries the components of a leg lock/release mechanism, generally indicated by the numeral 35, now to be described in detail.

Lock/release mechanism 35 includes an arcuate button 36 which is received in a slot 37 formed in housing top surface 33 and surfaces 26 and which is adapted to normally be approximately flush with these surfaces. A stem 38 extends downwardly from button 36 and terminates as a bearing flange 39 having a guide lug 40 projecting downwardly therefrom. Another guide lug 41 extends upwardly from housing bottom surface 34 and a coil spring 42 is received around and between lugs 40 and 41 to bear against flange 39 and maintain button 36 in its upward position.

Figure 4:
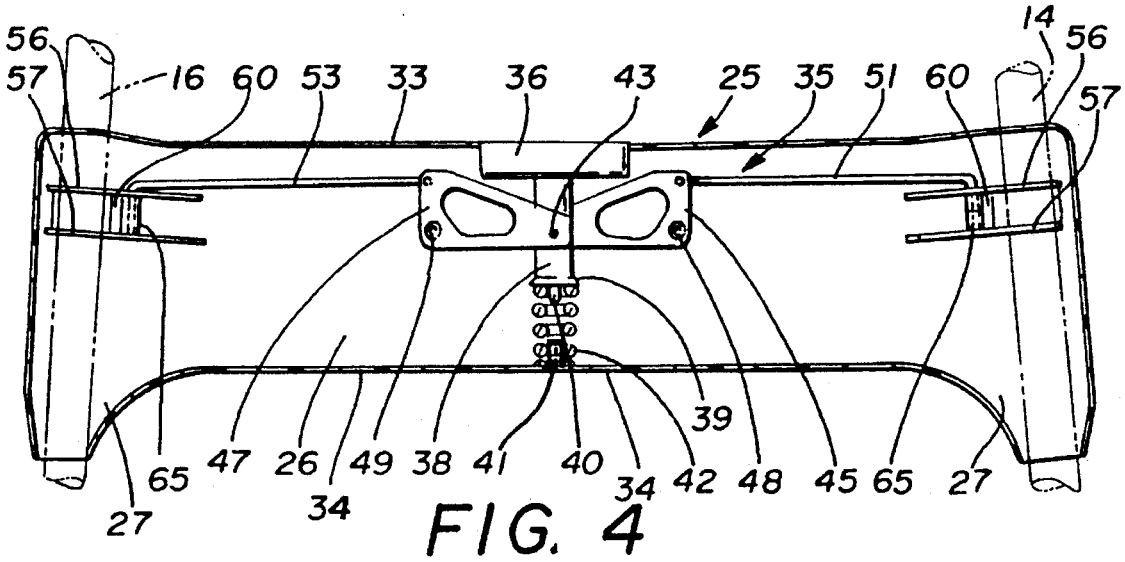
FIG. 4 is a sectional view taken substantially along line 4—4 of FIG. 1.
Figure 5:
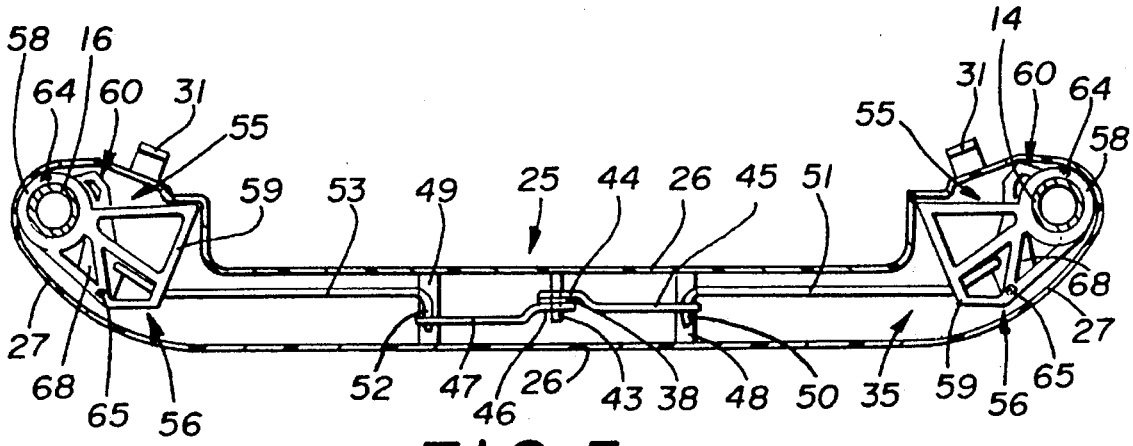
FIG. 5 is a sectional view taken substantially along line 5—5 of FIG. 1.
Figure 6:
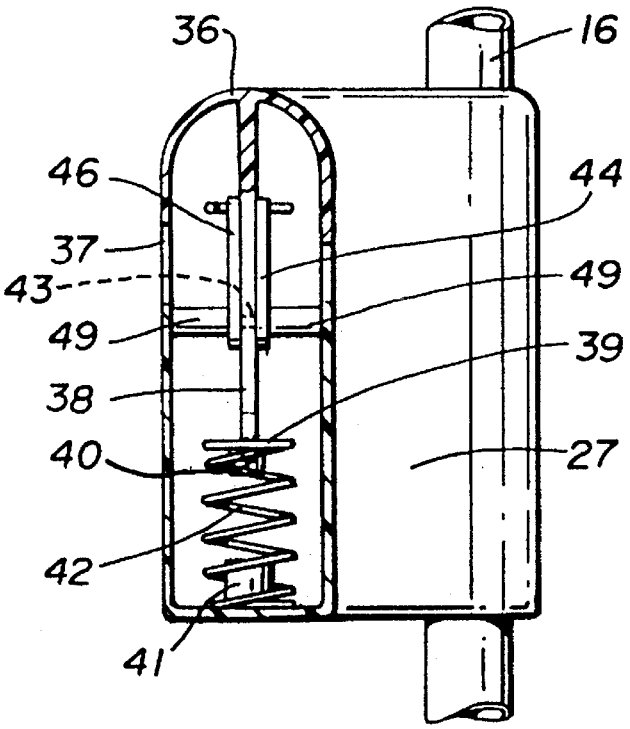
FIG. 6 is a sectional view taken substantially along line 6—6 of FIG. 1.

Button stem 38 includes a pin 43 which is received through a slot in the laterally inner and lower end 44 of a release lever 45 and through a slot in the laterally inner and lower end 46 of another release lever 47. The laterally outer and lower end of lever 45 is pin connected, as at 48, between walls 26 of housing 25 and similarly, the laterally outer and lower end of lever 47 is pin connected, as at 49, between walls 26 of housing 25. As will hereinafter become evident, when button 36 is depressed, lever 45 will rotate in a counterclockwise direction on pin 48 and lever 46 will rotate in a clockwise direction on pin 49. Because the laterally outward and upper end of lever 45 carries the hooked end 50 of a link rod 51, such motion will translate rod 51 to the left as viewed in FIGS. 4 and 5. Similarly, because the laterally outward and upper end of lever 47 carries the hooked end 52 of a link rod 53, such motion will translate rod 53 to the right as viewed in FIGS. 4 and 5. Such movement actuates latch mechanisms, generally indicated by the numeral 55, which are connected to the other end of rods 51 and 53. Because these latch mechanisms 55 are essentially identical, only the latch mechanism carried by rod 51 will be described with specific reference to FIGS. 7, 8 and 9, the components of the latch mechanism carried by rod 53 and shown in FIGS. 4 and 5 being given like reference numerals.

Figure 7:
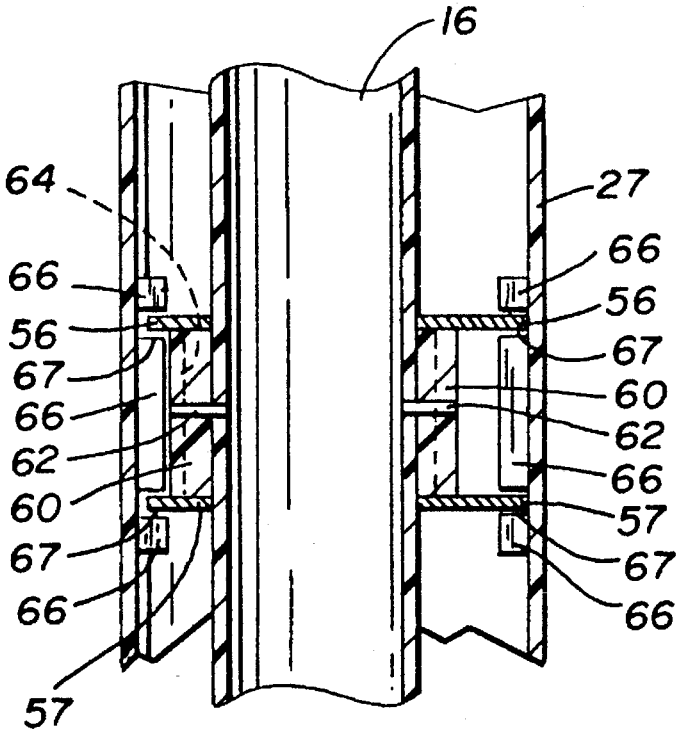
FIG. 7 is a sectional view taken substantially along line 7—7 of FIG. 1.

Each latch mechanism 55 includes an upper latch plate generally indicated by the number 56 and an identical lower latch plate generally indicated by the numeral 57 (FIG. 7). Latch plates 56, 57 are preferably made of a metallic material and include a circular portion 58 telescopically received around leg 14 and a lattice-like framework section 59 configured to spread the loads associated with walker 10 using a minimal amount of material. A lock sleeve, generally indicated by the numeral 60 and preferably made of a metallic material, includes a generally semicircular collar 61 which can be pin connected or pivoted to leg 14, as at 62, as shown in FIG. 7 with respect to leg 16. A boss 63 is carried by collar 61 and extends generally radially outwardly therefrom.

Rivet pins 64 and 65 attach upper and lower latch plates 56, 57 together with lock sleeve 60 sandwiched therebetween. Ends 27 of housing 25 are provided with a plurality of spaced ribs 66 forming slots 67 therebetween (FIG. 7) to receive an outer edge of latch plates 56, 57. Thus, the assembled plates 56, 57 and lock sleeve 60 are maintained in a vertical position relative to leg 14 and housing 25 with plates 56, 57 being stationary and with lock sleeve 60 being rotatable with leg 14. A pawl 68, preferably made of a rigid plastic material, is pivotally carried by rivet pin 65 and is engaged by the laterally outer end of link rod 51.

Figure 3:
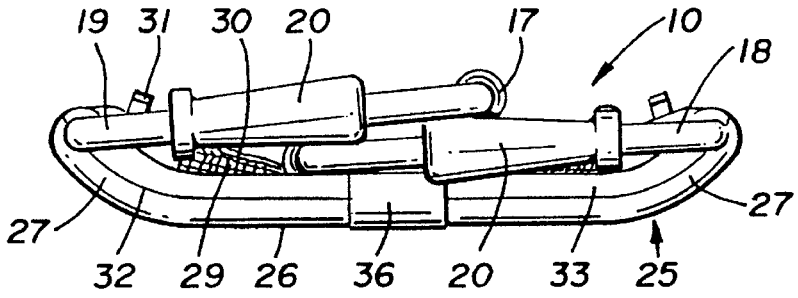
FIG. 3 is a top plan view showing the foldable walker of FIG. 1 in a folded condition.
Figure 8:
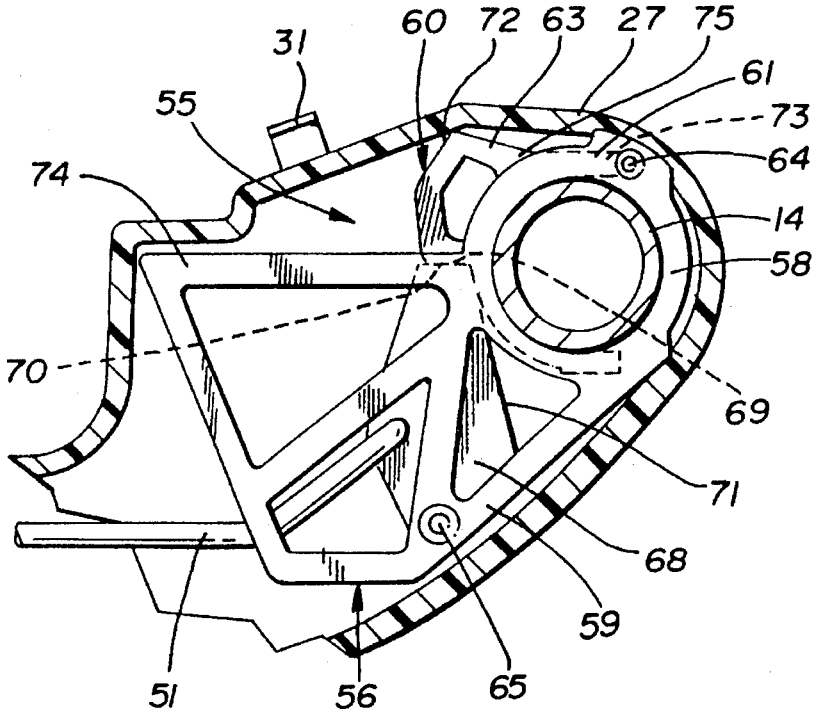
FIG. 8 is an enlarged fragmented view of the right portion of FIG. 5 showing the latch mechanism in a locked position.
Figure 9:
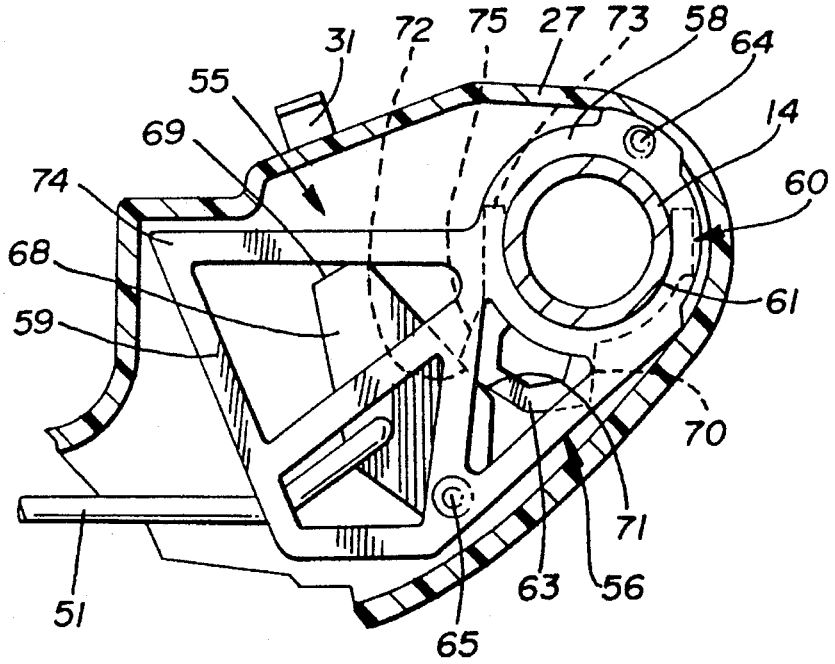
FIG. 9 is a view similar to FIG. 8 showing the latch mechanism in a released position.

The operation of lock/release mechanism 35 will now be described. In FIG. 8 latch mechanism 55 is shown in a locked position such that leg 14 cannot be rotated to fold walker 10. As such, the outer edge 69 of pawl 68, which may be slightly ramped, is engaging edge 70 of boss 63 to prevent such rotation. If the user would desire to fold walker 10, button 36 is depressed which, as previously described, pulls rod 51 to the left and rod 53 to the right as viewed in FIGS. 4 and 5. Such action pivots the pawl 68 of each latch mechanism 55 to the FIG. 9 position thereby allowing the user, with button 36 still being depressed, to manually rotate leg 14 (and leg 16) carrying sleeve 60 with it to the FIG. 9 folded position as also shown in FIG. 3. In this position, legs 13 and 15 are folded and located adjacent to housing 25 for easy storage of walker 10. With either leg 14 or leg 16, or both legs 14 and 16 being so unlocked, button 36 will remain depressed, despite the bias of spring 42, because of the interference between edge 71 of pawl 68 and surface 72 of boss 63. In fact, button 36 will stay depressed until both of the legs are returned to the fully locked FIG. 8 position thus giving the user a visual indication that one or both of the legs may not be fully locked in place. It is only then that spring 42 will return button 36 in its up position.

It should also be appreciated that the configuration of latch mechanism 55 prevents rotation of the legs in a direction opposite to their intended rotation. Such might occur if the user would try to rotate leg 14, for example, in a clockwise direction, as viewed in FIG. 8, which could also occur when extreme heavy downward forces of a person using walker 10 might be translated through mechanism 55 into unwanted rotary forces. To that end, when in the locked position, the edge 73 of collar 61 of lock sleeve 60 bears against pin 64 to absorb the load of an attempt to rotate the locked legs. Moreover, extreme attempts to rotate a locked leg are inhibited by the potential interference of components of mechanism 55 with housing 25. For example, the outermost edge 74 of lattice-like framework section 59 or the outermost point of edge 75 of boss 63 could engage housing 25 to prevent rotation in a direction opposite to that permitted when latch mechanism 55 releases its associated leg.

It should thus be evident that a foldable walker 10 constructed in accordance with the concepts of the present invention, as described above, accomplishes the objects of the invention and otherwise substantially improves the walker art.

We claim:

1. A foldable walker comprising a first pair of opposed legs; a second pair of opposed legs; one leg of said second pair of opposed legs being opposed to one leg of said first pair of opposed legs and the other leg of said second pair of opposed legs being opposed to the other leg of said first pair of opposed legs; a housing positioned between said one leg of said first pair of opposed legs and said other leg of said first pair of opposed legs; operating means carried by said housing to selectively lock said first pair of opposed legs to prevent rotation thereof relative to said housing and to release said first pair of opposed legs to permit rotation thereof relative to said housing so that said second pair of opposed legs may be positioned adjacent to each other and to said housing; said operating means including a depressible button, and latch means engaging said first pair of opposed legs to prevent rotation thereof but releasing said first pair of opposed legs when said button is depressed, said button remaining depressed until said latch means again engages said first pair of opposed legs to prevent rotation thereof.

2. A foldable walker according to claim 1 wherein there is a said latch means for each leg of said first pair of opposed legs and said operating means further includes release levers pivoted by the depression of said button, and link rods each connected at one end to said release levers and at the other end to one of said latch means.

3. A foldable walker according to claim 2 further comprising a stem depending from said button, a pin on said stem, and a slot in each said release lever receiving said pin therethrough.

4. A foldable walker according to claim 3 further comprising a spring biasing said stem to urge said button to the undepressed position.

5. A foldable walker according to claim 3 wherein said release levers are pin connected to said housing for rotation relative thereto.

6. A foldable walker according to claim 1 wherein there is a said latch means for each leg of said first pair of opposed legs and said each said latch means includes a lock sleeve attached to each said leg of said first pair of opposed legs, a boss on said lock sleeve, and a pawl engaging said boss to prevent rotation of each said leg of said first pair of opposed legs, said pawls being pivoted by the depression of said button to release each said leg of said first pair of opposed legs and permit rotation thereof.

7. A foldable walker according to claim 6 wherein upon rotation of at least one of said legs of said first pair of opposed legs, said boss engages said pawl to maintain said button depressed.

8. A foldable walker according to claim 6 where each said latch means includes upper and lower spaced latch plates telescopically received around each said leg of said first pair of opposed legs, said lock sleeve being position in the space between said latch plates.

9. A foldable walker according to claim 8 further comprising spaced ribs formed on said housing, the edges of said latch plates being received in the spaces between said ribs.

10. A foldable walker according to claim 8 further comprising rivet pins connecting said latch plates with said lock sleeve being sandwiched therebetween but being rotatable with respect to said latch plates.

11. A foldable walker according to claim 10 wherein said pawl is carried by and pivoted on one of said rivet pins.

12. A foldable walker according to claim 10 wherein said lock sleeve includes a generally semicircular collar portion attached to each said leg of said first pair of opposed legs and carrying said boss, a circumferential edge of said collar portion being engageable with one of said rivet pins to prevent undesired rotation of each said leg of said first pair of opposed legs.

13. A foldable walker according to claim 10 wherein each said latch plates includes a circular portion telescopically received around each said leg of said first pair of opposed legs and receiving one of said rivet pins therethrough, and a lattice-like framework attached to said circular portion and receiving another of said rivet pins therethrough.

14. A foldable walker according to claim 13 wherein at least a portion of said framework is positioned adjacent to said housing to prevent undesired rotation of each said leg of said first pair of opposed legs.

15. A foldable walker according to claim 1 further comprising a mesh pouch connected to said housing to carry items.

16. A foldable walker according to claim 1 further comprising hooks carried by said housing to carry items.

17. A foldable walker according to claim 1 wherein said housing is separable into two sections so as to gain access to the portion of said operating means positioned in said housing.

18. A foldable walker according to claim 1 further comprising a plastic brace between said one leg of said second pair of opposed legs and said one leg of said first pair of opposed legs, and a plastic brace between said other leg of said second pair of opposed legs and said other leg of said first pair of opposed legs.

19. A foldable walker according to claim 1 further comprising a top frame member connecting the top of said one leg of said second pair of opposed legs to the top of said one leg of said first pair of opposed legs, a top frame member connecting the top of said other leg of said second pair of opposed leg to the top of said other leg of said first pair of opposed legs, and a grip member carried by each said top frame member.

20. A walker having a first leg spaced from a second leg and a mechanism to prevent rotation of each leg and yet be operable to allow rotation of each leg, the mechanism comprising a depressible button, a release lever for each leg being pivoted upon the depression of said button, a link rod for each leg each having one end connected to a said release lever so that upon pivoting of each said release lever each said link rod is translated, a boss carried by each leg, a pawl connected to the other end of each said link rod, said pawl normally engaging said boss to prevent rotation of each leg but upon translation of said rods, said pawls pivoting out of the way of said bosses so that the legs can be rotated.

* * * * *